United States Patent [19]

Saenger

[11] Patent Number: 4,745,933

[45] Date of Patent: May 24, 1988

[54] METHOD AND APPARATUS FOR SECURING HAIRPIECES TO A WEARER'S HEAD

[76] Inventor: Ann M. Saenger, 3262-A San Amadeo, Laguna Hills, Calif. 92653

[21] Appl. No.: 822,338

[22] Filed: Jan. 27, 1986

[51] Int. Cl.[4] ..... A41G 3/00

[52] U.S. Cl. ..... 132/53; 132/46 R

[58] Field of Search ..... 132/53, 54, 46, 55

[56] References Cited

U.S. PATENT DOCUMENTS

| | | | |
|---|---|---|---|
| 2,781 | 9/1842 | Deville | 132/54 |
| 2,579,089 | 12/1951 | Price | 132/46 R |
| 3,046,999 | 7/1962 | Lint | 132/54 |
| 3,419,020 | 12/1968 | Courtney | 132/54 |
| 3,467,111 | 9/1969 | Benson | 132/46 R |
| 3,471,867 | 10/1969 | Kirchhoff | 132/46 R |
| 3,474,798 | 10/1969 | Tillotson | 132/53 |
| 3,695,278 | 10/1972 | Rieger et al. | 132/53 |
| 3,724,470 | 4/1973 | Wilson | 132/46 R |
| 3,809,100 | 5/1974 | Megna | 132/53 |
| 4,254,784 | 3/1981 | Nelson | 132/53 |

FOREIGN PATENT DOCUMENTS

| | | | |
|---|---|---|---|
| 2302421 | 7/1974 | Fed. Rep. of Germany | 132/53 |
| 1388300 | 3/1975 | United Kingdom | 132/53 |
| 1494787 | 12/1977 | United Kingdom | 132/53 |

*Primary Examiner*—Gene Mancene
*Assistant Examiner*—J. Hakomaki
*Attorney, Agent, or Firm*—Jackson & Jones

[57] ABSTRACT

A method and apparatus relating to accessory items for persons who wear wigs and the like is disclosed.

A foundation cap securely holds a wig in place on the wearer's head. An accessory item for bald or nearly bald wearers secures the foundation cap to the scalp. The foundation cap comprises a nylon-like stretch material having a closed rounded end and an elasticized open end. A circular skirt of similar stretch material is located at about the midpoint of the foundation cap. Filler material is inserted, as needed, into the cap. For a bald, or near bald wearers, an accessory item comprising an elastic band integrally housing a pre-rolled filler section is first placed over the head to hold the foundation cap in place.

The method employs first and second substantially flat rolled sections which are located near the wearer's natural hairline before the wearer's hair loss. The rolled sections comprise absorbent material which is rolled into the wearer's existing hair, and encircles the head with flat sections near the top of the ears and mounds at the front and back to secure the foundation cap and finally the hairpiece.

4 Claims, 1 Drawing Sheet

FIG. 1
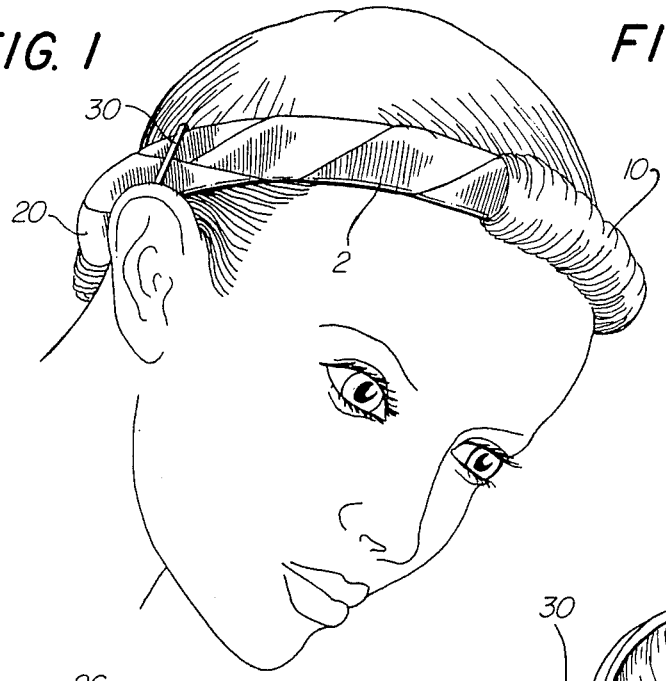
FIG. 5
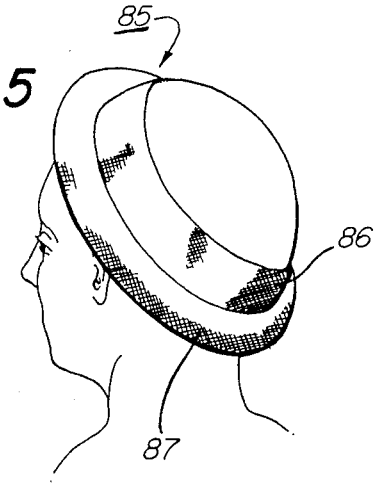
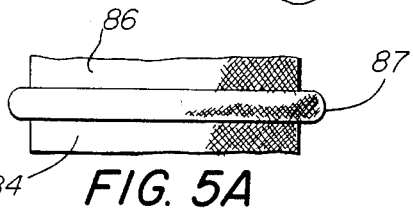
FIG. 5A
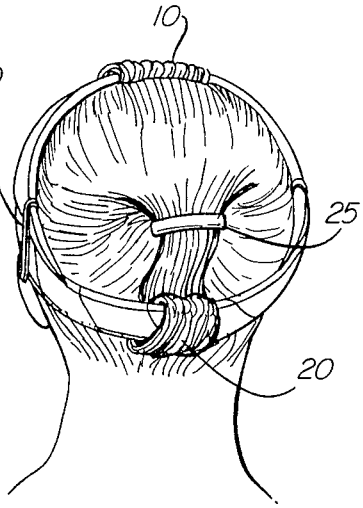
FIG.1A
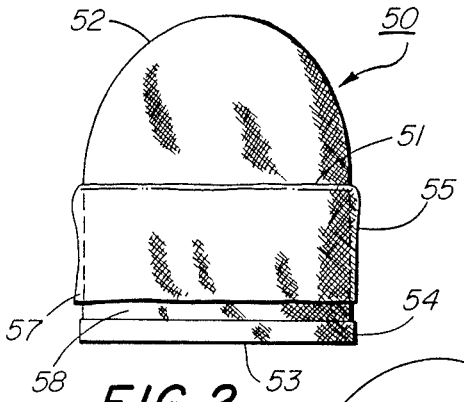
FIG. 2
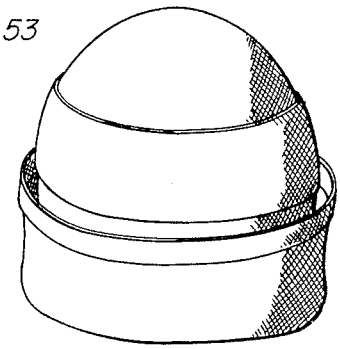
FIG. 3
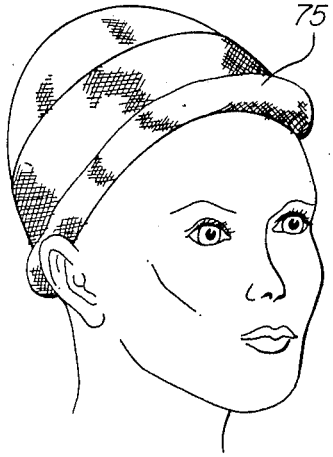
FIG. 4

METHOD AND APPARATUS FOR SECURING HAIRPIECES TO A WEARER'S HEAD

BACKGROUND OF THE INVENTION

1. Origin of the Invention

The invention described herein is the work of the named inventor in response to a need for a simple, secure and efficient foundation cap to hold a hairpiece for a wearer. Female wearers, and particularly those having fine and little or no natural hair can benefit greatly by this invention.

2. Field of the Invention

This invention relates to accessory items for persons who wear wigs and the like. More particularly, the invention relates to a snug but not tight fitting foundation cap for comfortably and securely holding a wig in place on the wearer's head. An additional accessory item to be worn beneath the essential foundation cap will secure the foundation cap in place for bald or nearly bald wearers. Disregarding hair density, use of one or both accessory items can safely and snugly secure the wearer's wig so that styling can be done on the wig while it is being worn.

The accessory item used by bald or near bald wearers is comprised of two wide elastic band areas integrally housing a pre-rolled filler section which completely encircles the wearer's head. For all other users, a method and apparatus employs first and second rolled sections. Each rolled section is comprised of an absortent material in variable quantity; more filler material in the center of each section and then tapering from center to flattened end. Both rolled sections are used with the wearer's existing hair. One rolled section employs use of a wearer's natural hair in an area of the wearer's natural frontal hairline, slightly toward the crown. The second rolled section is located back of the wearer's head in a desired location between the nape of the neck and top of the ear.

BACKGROUND OF THE INVENTION

Today's lifestyle has created a demand for a way of firmly securing a hairpiece to a wearer's head. Some wearers use the wig for stylish purposes. Other wearers have at least some hair with bald spots that require covering by a hairpiece for an enhanced appearance. Some bald or near bald women can benefit by an elastic cap with a pre-rolled section which is placed over the head to substitute for the lack of natural hair. In any event a natural looking, secure and styllable wig is highly desirable. The apparatus and method of this invention provides an advantageous approach in that a manufactured wig and its base may be safely and readily secured to the wearer's head.

BRIEF DESCRIPTION OF THE PRIOR ART

The prior art disclosed by a search includes the following U.S. Pat. Nos. 3,788,332; 3,046,999; 2,661,749; 4,254,784; 2,474,148 and 3,419,020.

The '332, '999 and '749 patents all disclose wig foundations of the type normally supplied by a manufacturer along with the hair strands which form the wig. These foundations do not secure a wig to a wearer's head, but rather serve as a base upon which to attach hair strands required in the construction of a wig. The purpose and design is different from the invention.

Nelson '784 discloses a method of attaching a wig to a wearer's head. Apertured tubes are attached to the wearer's natural hair and the wig is attached to the tubes. See FIGS. 1 and 2, and column 2, lines 3–29. The invention clearly distinguishes over this disclosure.

Horton '148 discloses a hair pad of filler material for adding wave and contour to the hair. It does not teach or suggest use of filler in a foundation cap which provides a snug and natural-looking means for affixing a wig to the wearer in accordance with this invention.

Courtney '020 discloses a subsurface hair elevator to which a wig may be secured. See FIG. 2 and column 2, lines 33–39.

The structure of the elastic cap, filler material and the method steps of the subject invention is not found nor suggested by the prior art. None of the prior art teaches or suggests an accessory elastic cap with a pre-rolled section to substitute for the lack of natural hair on a bald or near bald wearer.

SUMMARY OF THE INVENTION

Briefly, the subject invention comprises a wig foundation cap, an elastic band for bald or near bald wearers and a method involving same and including the steps of using either or both to secure a wig to the wearer's head.

The foundation cap comprises a nylon-like stretch material having a closed rounded end and an open end. An elastic band is formed at the open end so that the foundation cap can be snugly fitted to the wearer's head. A circular skirt of similar stretch material is located at about the midpoint of the foundation cap. That circular skirt is either sewn or otherwise formed with the cap. The cap is expandable and provides considerable versatility for the unique needs of any individual user. Filler material is inserted, as needed, into the expandable cap and/or the circular skirt in amounts as required to shape it to the wearer's head for maximum comfort and fit. The filler and cap foundation enhances the natural look of the wig when finally affixed to the foundation cap. The portion of the cap which is between the elastic band and the midpoint may also receive filler material which can be rolled into place and held secure by rolling the elastic band and cap material upwardly on the foundation cap.

The method of the invention makes use of rolled tissue or towelling wrapped in the wearer's hair to form a base to receive and firmly secure the foundation cap, and thus the wig, in place. The method involve two sections of the wearer's natural hair. The first section is at the top front slightly above the natural hairline wherein about a two inch wide section of natural hair is rolled into a flat or near flat, towel which may include filler. A mound of natural hair and filler is formed at the scalp and it extends from the front to above the wearer's ears. The second section is formed by combing the remaining natural hair around the face then behind the ears into a center back location between the top of the head and the nape of the back of the neck and securing same with a barrette or the like. That hair is likewise rolled into a flat or near flat filler section that extends at the scalp from the back toward the ears. The exact location of the back section varies according to the natural hair and the length of wig to be worn. Each rolled section of natural hair and filler can be varied as required by both the wearer and the wig or hairpiece. The object being to encircle the head with flat sections near the top of the ears and mounds at the front and back to secure the foundation cap and the hairpiece. In the method of this invention, the stretch cap accepts filler material as needed by the particular user to absorb perspiration and to better conform the wig to the user's head.

BRIEF DESCRIPTION OF THE DRAWINGS

FIG. 1 depicts use of the wearer's natural hair rolled with abosrbent rolls for increased security in attaching the foundation cap to the wearer in accordance with the invention;

FIG. 1A depicts a frontal, and rear roll joined near the top of the ears;

FIG. 2 depicts a foundation cap with a midpoint skirt in accordance with this invention;

FIG. 3 depicts the midskirt of the foundation cap partially rolled upwardly;

FIG. 4 depicts the filled cap in place on the wearer; and

FIG. 5 and 5A depicts the accessory band with a pre-rolled section for bald or near bald wearers.

DETAILED DESCRIPTION OF THE DRAWINGS

FIG. 1 depicts a front, and rear rolled section of absorbent material 2 rolled and pinned together and including the wearer's natural hair. Front roll 10 is formed from an absorbent paper towelling 2, or similar type material. Rolling the front roll 10 and rear roll 20 with the existing natural hair of the wearer provides secure attachment mounds at the back of the head and near the forehead. Each roll, includes a mound of towelling 2 and natural hair with the mounds being flat near the top of the ears. Towelling 2 adds bulk to the wearer's natural hair,and also assists to absorb perspiration. The added bulk prevents the foundation cap and also the wig from creeping, as will subsequently be described.

It is to be noted that the amount of towelling 2 in the rolls will vary from wearer to wearer. Each roll however is placed close to the scalp.

As shown in FIG. 1, rear roll 20 is adjacent to and slightly overlaps the front roll 10 near the top of ears. Back roll 20, FIG. 1A, uses most of the wearer's remaining hair, not rolled into front roll 10, to complete a rolled section of towelling and natural hair which encircles the wearer's scalp. This circular mound, it should be noted, does not require all of the wearer's hair to be formed into the rolls 10 and 20. Indeed, any remaining hair may be pinned to the top of the wearer's head inside of the circular mound by a barrette or other fastener 25, FIG. 1A, or it may be concealed under the cap.

In order to form the front and rear rolled sections 10 and 20 pieces of flat absorbent towelling is used. A flat sheet of towelling may include some crumpled tissue or towelling placed in the center section of a roll to be formed. That flat section is rolled like a cinammon roll to form a flat towel section which is more bulky in the center. Bobby pins may secure the towelling ends during the rolling step with the wearer's natural hair.

The user combs the existing natural hair back and away from the face and allows it to hang down on all sides. A front section of natural hair is parted and held vertically up and down from the forehead. The end of that front section receives the center portion of the flat folded towel material which is, in turn, rolled either forwardly or backwardly with the existing parted hair until the combined towel and hair is at the scalp above the forehead. The tapered ends are smoothed from the front to the top of the ears.

The remaining natural hair is combined away from the face and behind the ears to form a hair section extending outwardly from the center of the back of the head secured by a barrette. That section of the hair is then rolled as before into a second flat folded towel.

The rolling can either be in a forward or reverse direction. The towelling and natural hair is rolled to the scalp and the tapered ends of the towel are smoothed toward the front where they join with the ends of the frontal mound. Bobby pins 30 hold the towelling ends together above the ears. FIGS. 1 and 1A depict the circular sections formed by mounds 10 and 20 at the scalp locations.

The style of the wig will ultimately define where and how the rolls 10 and 20 are placed. For example, if a short wig is worn, the rear roll 20 will be located higher toward the crown of the head. Both flattened ends of both rolled sections will meet above the ears. Thus in FIG. 1A the rear roll 20 can be located from the barrette position on down as needed. Obviously, the natural hair may be rolled straight downwardly, or slanted as is needed to complete an almost circular rolled section. For a wig with bangs, the front hair section may be slanted forward slightly and formed into front roll 10. For a wig without forehead-styled bands, the natural front hair is slanted and rolled up and away from the forehead. If the wig style is long in the back, the hair is slanted and rolled under to form a circular section at the base of the wearer's head. If the wig style is short the back roll 20 is higher toward the crown.

Not all the hair need be in the rolls 10 and 20. Stray ends are hidden beneath the cap. When the rolled sections 10 and 20 are completed, the rolled section is near the scalp where the wearer's natural hairline would have been prior to hair loss. The objective is to form a circular rolled section around the wearer's head near the wearer's natural hairline.

Foundation cap 50 is shown in FIG. 2. Cap 50 comprises a nylon-like stretch material having a closed rounded end 52 and an open end 53. An elastic band 54 is formed at the open end 53 so that the foundation cap 50 can be snugly held on the wearer's head.

A circular skirt 55 of similar stretch material is located at about the midpoint 51 of the cap 50. That circular skirt 55 is either sewn or otherwise formed with cap 50.

The foundation cap 50 is employed to fill out the space at the top of the head to better conform the wearer's head to the shape of the wig net or base. For example, filler may be inserted around the cap and underneath the elastic when the elastic has been rolled back and upwardly away from the scalp to form a filler pocket 75, FIG. 4, which pocket 75 encircles the head at a location forward of the rolled sections 10 and 20.

Pocket 75 is formed between the elastic band 54 and the point where the circular skirt 55 is fastened. Pocket 75 is filled as needed so that, with foundation cap 50 in place, a shaped foundation is formed from the first rolled section at the wearer's natural hairline upward and over the wearer's head. The loose end 57 of the circular skirt 55 is available to receive filler material in the amount which is required to enhance the natural look of the wig when finally affixed to the foundation cap 50. If filler is not needed the loose end 57 can be gently pulled downwardly to obscure the front and rear mound areas and any filler material that has been used.

Portion 58 of the cap 50 which is located between the elastic band 54 and the midpoint receives filler material 2 which can be rolled into place and held secure by rolling the elastic strap 54 and portion 58 of cap 50 upwardly on itself as depicted in FIG. 4.

A wig's base, as is known, is naturally flexible to a slight degree. The wig is pulled on at the forehead and down at the sides and rear. The wig normally fits snugly at the top of the ears and the flattened sections discussed earlier provides space for this snug fit. Since the foundation cap 50 has been formed with an outwardly-facing hairline rolled section, the wig is securely held in place against the scalp forward and below rolled section 75, FIG. 4. The wig need not but may be further attached by bobbie pins or the like to the foundation cap 50, if so desired.

As discussed earlier natural hair helps hold the foundation cap to the wearer's head. For bald or near bald people or those with very fine hair FIGS. 5 and 5A depicts an accessory item 85. This item 85 comprises two elastic bands 84, 86 provided with a pre-rolled and filled section 87. Section 87 is pre-rolled to act as a substitute for the towelling and natural hair disclosed in FIGS. 1 and 1A. Pre-roll 85 may be fitted with an opening (not shown) near the elastic band 86 so that the amount of filler which forms the section 87 can be adjusted for the needs of a particular wearer. Foundation cap 50 is placed over the accessory item as discussed earlier to provide a safe, secure and comfortable foundation for a hairpiece.

The experience of the inventor has shown that a wig, when attached to a foundation cap 50 in accordance with the method of this invention, fits the individual wearer's head shape and wig size. The combination of the foundation cap and rolled sections of natural hair and filler in the cap makes the wig feel like natural hair. Additionally, the wig may be brushed, combed and styled while being worn. Conditions of stress for wig wearers such as wind, rain, sleet and the like are met without the wig being blown away or disturbed to a point of noticeable disarray. The elastic material of the cap and accessory of this invention may be selected to compliment the complexion and color of the individual wearer.

The above description presents the best mode contemplated in carrying out my invention. My invention is, however, susceptible to modifications and alternate constructions from the embodiments shown in the drawings and described above. Consequently, it is not the intention to limit the invention to the particular embodiments disclosed. On the contrary, the invention is intended and shall cover all modifications, sizes and alternate constructions falling within the spirit and scope of the invention, as expressed in the appended claims when read in light of the description and drawings.

What is claimed is:

1. A foundation for a wearer's head for holding a wig on a premade wig base, said foundation comprising:

a stretch stocking-type foundation cap having an open end and a rounded closed end which generally conforms to the shape of a wearer's head crown, said cap being made of a rollable flexible material permitting same to be placed upon a wearer's head, pulled down near the ears and to be rolled backward and upwardly upon itself to form a filler receiving pocket, which pocket, when formed, acts as a raised circular ridge to receive an outer periphery of said premade wig base and tends to hold same in place on the wearer's head;

an elastic band surrounding the open end of said foundation cap to form an elasticized open end of said cap, said open end, when rolled back and away from the wearer's scalp, forming a stretchable, flexible filler-receiving pocket which elastically forms said circular ridge above the wearer's forehead, above the wearer's ears at the sides and the lower back crown of the wearer's head; and a flexible circular skirt with one edge loose and one edge fixed near a midpoint location between the closed end and the elasticized open end of said foundation cap for receiving additional filler which conforms the foundation cap to the wearer's head in a shape to fittably receive the premade base of a wig to be worn and, if said circular skirt is not needed for said additional filler material, said loose skirt naturally conforms to the cap when the wig is in place.

2. The foundation cap of claim 1 in combination with an accessory item for a bald or near bald person to use as a preliminary base which is placed on the wearer's scalp to receive said foundation cap, said accessory item comprising:

an elastic band and a pre-rolled raised section adapted to encircle the wearer's head and to act as a barrier over which said elasticized open end of said foundation cap may be placed.

3. A foundation for a wearer's head to secure a wig to be worn, said foundation comprising:

a stocking-type cap having a closed end which generally fits a wearer's head crown when worn and a first descending skirt of stretchable and rollable material terminating in an open end of said cap;

elastic means located around said open end of said first descending skirt of said cap for receiving and holding a filler when the elastic means and said first descending skirt end are rolled upon itself by rolling back and upwardly away from the wearer's forehead, sides and back to form an essentially circular-shaped raised ridge tending to hold said wig in place on said wearer's head; and a second circular skirt fixed around the first descending skirt on the outside thereof for forming another filling receiving pocket accessable for receiving filler as desired by the wearer.

4. In combination with claim 3, an accessory item for a bald or near bald wearer to use as a preliminary base that is placed on the wearer's scalp prior to the wearer's use of the foundation of claim 3, said accessory item comprising;

an elastic band; and means fastened to the outer side of said elastic band when worn, said means adapted to encircle the wearer's head and act as a raised barrier over which the wearer places said elastic means of said foundation.

* * * * *